US005683307A

United States Patent [19]

Rife

[11] Patent Number: 5,683,307

[45] Date of Patent: Nov. 4, 1997

[54] PUTTER TYPE GOLF CLUB HEAD WITH BALANCED WEIGHT CONFIGURATION AND COMPLEMENTARY BALL STRIKING FACE

[76] Inventor: Guerin D. Rife, 1230 Via Salerno, Winter Park, Fla. 32789

[21] Appl. No.: 272,607

[22] Filed: Jul. 11, 1994

[51] Int. Cl.[6] ..... A63B 53/04

[52] U.S. Cl. ..... 473/313; 473/350; 473/345; 473/314; 473/327; 473/340

[58] Field of Search ..... 273/167 H, 173, 273/167 F, 167 D, 167 E, 162 E, 169; 473/313, 350, 345, 314, 327, 340

[56] References Cited

U.S. PATENT DOCUMENTS 2,213,190 9/1940 Haverbach ..... 273/162 E
3,708,172 1/1973 Rango ..... 273/162 E
3,779,398 12/1973 Hunter ..... 273/162 E
4,795,158 1/1989 Kuykendall ..... 273/167 R
5,429,354 7/1995 Long et al. ..... 273/169

*Primary Examiner*—Vincent Millin
*Assistant Examiner*—Charles W. Anderson
*Attorney, Agent, or Firm*—Aquilino & Welsh

[57] ABSTRACT

A putter type golf club head having a weight distribution formed by a cavity in the upper surface whereby the predominance of the weight of the head is at the heel, toe and bottom portions thereof. This weight configuration is combined with a ball striking face having a loft no greater than three degrees. The weight distribution, acting to lift the ball when it is struck, eliminates the need for a more lofted ball striking face.

7 Claims, 2 Drawing Sheets

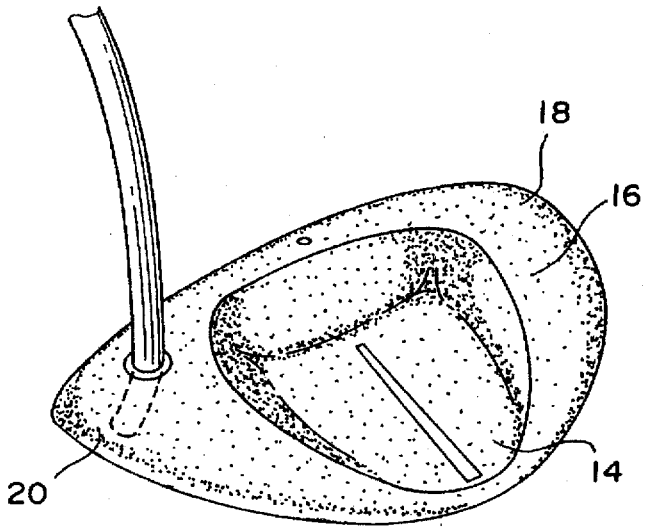
FIG. 1
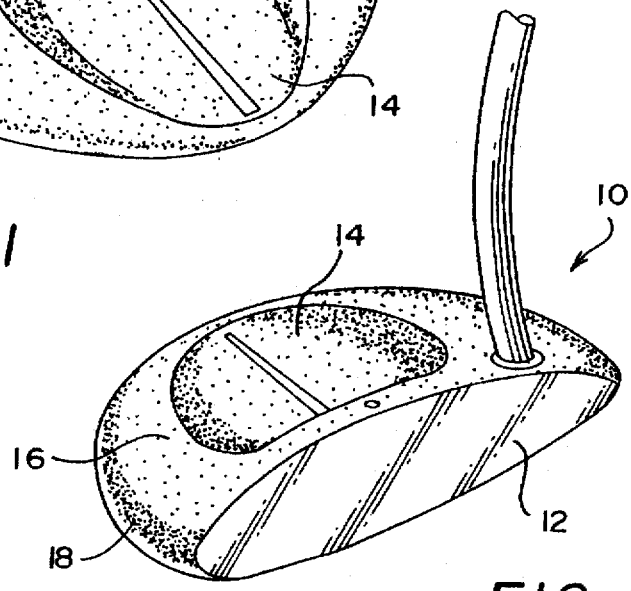
FIG. 2
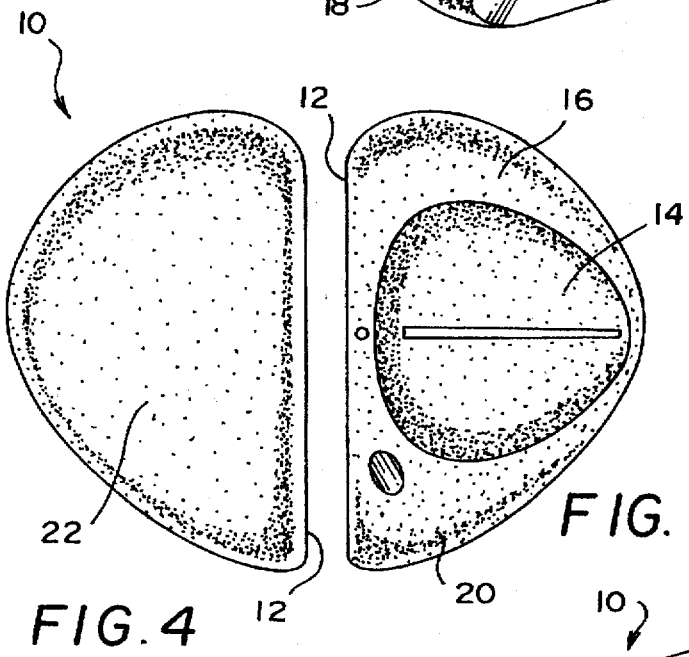
FIG. 4
FIG. 3
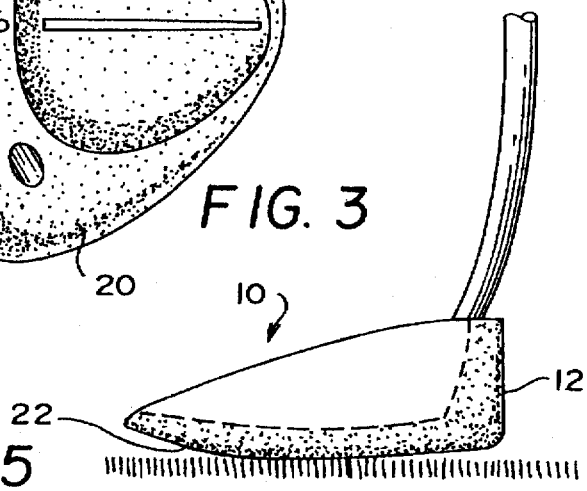
FIG. 5

PUTTER TYPE GOLF CLUB HEAD WITH BALANCED WEIGHT CONFIGURATION AND COMPLEMENTARY BALL STRIKING FACE

BACKGROUND OF THE INVENTION

The present invention relates to putter type golf club heads, and in particular to a uniquely weighted putter type golf club head design which permits a zero or negative loft ball striking face.

Most conventional putter type golf club heads are provided with a degree of loft that ranges from three to as much as ten degrees. The loft causes a ball to be hit into the air several inches when it is struck, before contacting the ground surface. Once the ball strikes the ground, it skids for an additional length until it begins to roll, end over end, with spin toward the target. This design goes back a number of years to when golfing greens were much slower and contained many more imperfections than the modern greens of today's golf courses. Many modern putting surfaces are virtually smooth with few imperfections, so that it is no longer necessary to elevate the ball when it is initially struck to enable the ball to roll straight.

Ideally, a putter configuration for modern greens would allow the ball to roll immediately upon being struck, with only a slight lift off the putting surface. This creates instantaneous overspin, without bouncing, to help the ball maintain its line toward the target hole.

SUMMARY OF THE INVENTION

The present invention is directed to an improved putter type golf club head which is bottom weighted. The weight is distributed by taking the weight from the top of the club head and adding it to the bottom, and this bottom weight on a golf club head lifts the ball higher when struck. This increased lift allows for loft to be removed from the club face, since the bottom weight lifts the ball, enabling it to begin rolling. Lift without loft provides more forward spin, and the skidding effect of conventional loft face putters is eliminated. Preferably, the loft of the putter of the present invention is no greater than three degrees and may be zero degrees (no loft), or even negative loft.

It will be appreciated that the underlying principles of the present invention may be applied to any shape of putter head. However, the invention is particularly useful with mallet-head type putter heads wherein large portions of the top surface of the club head may be removed. A preferable structure is a rearwardly extending, centrally located cavity with the weight distributed between the heel and toe areas and the bottom of the club head.

Among the objects of the present invention are the provision of a putter type golf club head which provides an improved weight distribution in order to cause a golf ball to immediately roll, particularly when used on modern, smooth surfaced putting greens.

Another object of the present invention is the provision of a putter-type golf club head having a ball striking face loft no greater than three degrees in order to maintain a golf ball closer to the ground immediately after impact.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 1 shows a rear perspective view of a putter type golf club head in accordance with the present invention.

FIG. 2 is a front perspective view of the putter type golf club head of FIG. 1.

FIG. 3 is a top plan view of the golf club head of FIG. 1.

FIG. 4 is a bottom view of the golf club head of FIG. 1.

FIG. 5 is a sectional view taken along the lines 5—5 of FIG. 2.

DESCRIPTION OF THE PREFERRED EMBODIMENTS

Figure 6:
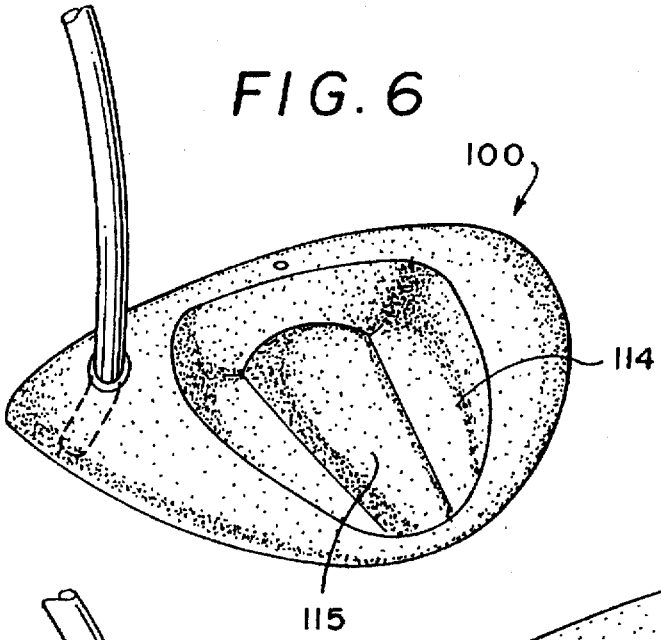
FIG. 6 is a rear perspective view of a second embodiment of a putter type golf club head in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Reference will now be made in detail to the preferred present embodiment of the invention, examples of which are illustrated in the drawings. Wherever possible, like references will be used to refer to like parts.

FIGS. 1–5 illustrate a first embodiment of a golf club head 10 in accordance with the present invention. The putter type golf club head is made in accordance with the principles of the present invention, that is, the weight is distributed to the bottom portion of the club head 10 and the ball striking face 12 is provided with a loft angle no greater than three degrees and which may have no loft (zero degrees), or even negative loft with respect to the ground support surface. The club head 10 is teardrop-shaped and is provided with a centrally positioned teardrop-shaped cavity 14 formed in the top surface 16 of the club head 10. Preferably, cavity 14 is located midway between the toe 18 and the heel 20 of the club head. The cavity creates a weight distribution at the bottom 22, toe 18 and heel 20 portions of the club head. FIG. 5 shows the mass of the club head located behind the ball striking face 12 at the bottom 22 of the club head.

Referring to the drawings, it can be seen that the dimension of the club head 10 in the front to rear direction is approximately two thirds of the dimension in the heel 20 to toe 18 direction. This creates a relatively long cavity 14 thereby locating a significant amount of the overall mass of the club head 10 along the bottom 22. See FIG. 5. This, in turn, lowers the center of gravity toward the bottom 22 of the club head 10. A hosel socket 24 is located on the top surface 16 spaced inwardly from the heel 20 toward the cavity 14. Both the dimensions of the cavity 14 and the location of the hosel socket 24 create lift to a golf ball when it is struck by the present invention thereby permitting a less lofted ball striking face 12.

As indicated previously, the combination of the loft of the ball striking face 12 and the bottom weight distribution causes a golf ball struck by the putter to be lifted from the support surface. When the putter is used on greens that are essentially Smooth, of the type found on many modern golf courses, the ball, when struck, begins to roll immediately, without skidding, therefore increasing the chance of the ball maintaining its selected target line.

FIG. 6 illustrates a second embodiment of a putter type golf club head 100 made in accordance with the present invention, including a rear cavity 114 formed in the top surface 116 of the club head 100. In this embodiment, an auxiliary weight 115 is provided in the bottom of the cavity and is oriented in a front to rear position. This arrangement further amplifies the bottom weight distribution by placing an additional mass 115 at a point directly under the place on the ball striking face where a golf ball would normally be struck.

Figure 7:
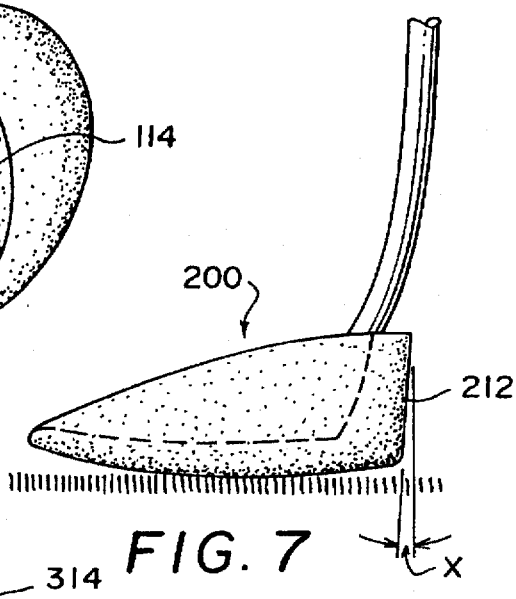
FIG. 7 is a side sectional view of a third embodiment of a putter type golf club head in accordance with the present invention.

FIG. 7 illustrates a side sectional view of a third embodiment of a putter head 200, including a ball striking face 212, which has negative loft. It will be appreciated that the negative loft angle has been exaggerated for illustrative purposes only, however, the negative loft could be as much as five degrees.

Figure 8:
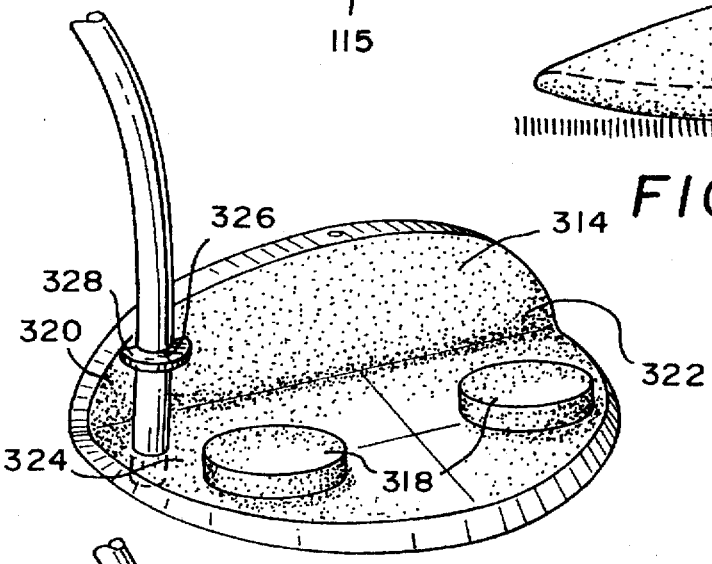
FIG. 8 is a rear perspective view of a fourth embodiment of a putter head in accordance with the present invention.
Figure 9:
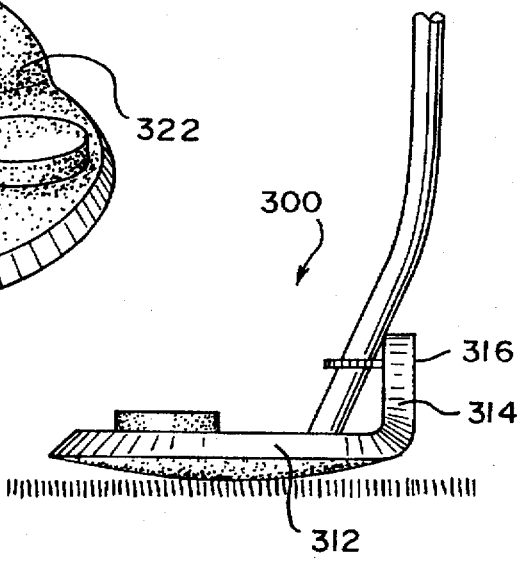
FIG. 9 is a side elevational view of the putter of FIG. 8.

FIGS. 8 and 9 show a fourth embodiment of a golf club head 300 in accordance with the present invention. In this embodiment, the putter head is formed of a tapered bottom or base section 312 and an upright section 314 which forms a two degree or less ball striking face 316. The base 312 is provided with a series of adjustable weights 318 located toward the heel 320 and toe 322 of the club head 300, respectively. The weights are removable and adjustable so that a variety of weight configurations may be provided to accommodate the particular putting characteristics of an individual golfer. Preferably, the weights 318 would be threadedly attached by means of a stud (not shown), or otherwise fastened to the bottom base 312. In this embodiment, the club head 300 is also provided with an alignment means including alignment indicia 324 formed on the base 312 which cooperates with alignment markers 326 formed on a shelf 328 attached to the rear of the upright portion 314.

Figure 10:
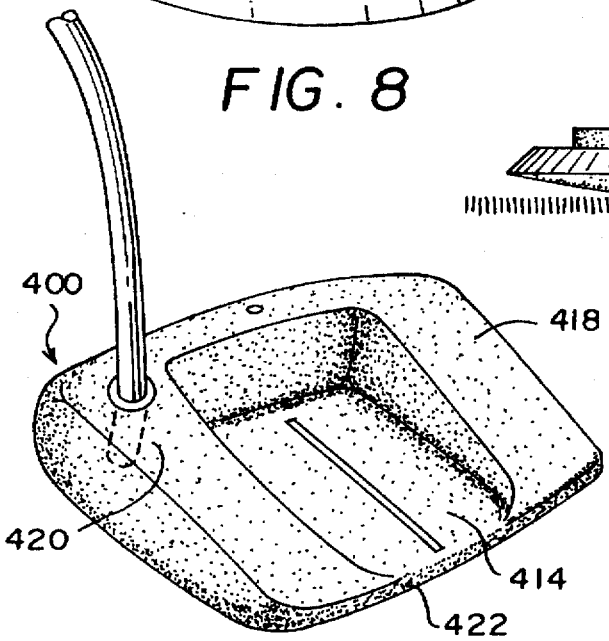
FIG. 10 is a rear perspective view of a fifth embodiment of a putter head in accordance with the present invention.

It will be further appreciated that the putter type golf club head of the present invention may be made in a variety of configurations. For example, FIG. 10 shows an embodiment of a putter head 400 which is relatively rectangular in configuration. A variety of other shapes may be provided. In this embodiment, the putter head 400 includes a square shaped rear cavity 414 which distributes the weight toward the toe 418 and heel 420, as well as the bottom 422 of the club head 400.

It will be apparent to those skilled in the art that other modifications and variations can be made in the putter type golf club head of the present invention without departing from the spirit or scope of the invention. Thus, it is intended that the present invention cover the modifications and variations of this invention provided these come within the scope of the appended claims and their equivalents.

I claim:

1. A putter type golf club head comprising a top surface, a bottom, a ball striking face, heel toe and rear surface, said club head having a dimension in a direction between the ball striking face and the rear surface which is two thirds of the dimension in a directions between the heel and toe; a cavity formed on said top surface extending rearwardly from a location adjacent the ball striking face to a location adjacent the rear surface; said cavity extending at least three quarters of the total dimension between the ball striking face and the rear surface whereby the majority of the mass of the club head is located at the toe, heel and bottom thereof; said ball striking face having a loft angle no greater than three degrees.

2. The putter head of claim 1 wherein said ball striking face is provided with zero degrees of loft.

3. The putter head of claim 1 further including an auxiliary weight formed in said cavity in a front to rear direction.

4. The putter head of claim 1 wherein said putter head is provided with removable, adjustable weights adjacent the bottom of said putter head.

5. The putter head of claim 1 wherein said club head is teardrop-shaped.

6. The putter head of claim 5 wherein said cavity is teardrop-shaped.

7. The putter head of claim 1 further including a hosel socket located on said top surface and located inwardly from said heel toward said cavity.

* * * * *